US005553643A

United States Patent [19]

Goldfarb et al.

[11] Patent Number: 5,553,643

[45] Date of Patent: Sep. 10, 1996

[54] APPARATUS AND METHOD FOR RAPIDLY ROTATING CONTAINERS TO PRODUCE MULTI-ASPECT DESIGNS

[75] Inventors: Adolph E. Goldfarb, Westlake Village; David A. Jackson, Sherman Oaks; Martin I. Goldfarb, Santa Monica, all of Calif.; Fred D. Eddins, Mapleville; Linwood E. Doane Jr., Cumberland, both of R.I.

[73] Assignee: Hasbro, Inc., Pawtucket, R.I.

[21] Appl. No.: 387,025

[22] Filed: Feb. 10, 1995

[51] Int. Cl.[6] ..... B65B 1/14

[52] U.S. Cl. ..... 141/34; 141/9; 141/95; 141/100; 141/253; 118/52; 434/84; 434/101; 446/236

[58] Field of Search ..... 141/9, 34, 98, 141/100, 104, 253; 446/146, 236, 246; 118/52, 317, 320, 500, 501; 434/84, 101

[56] References Cited

U.S. PATENT DOCUMENTS 3,509,920 5/1970 Word ..... 141/100

4,159,028 6/1979 Barker et al. ..... 141/9

5,312,487 5/1994 Akimoto et al. ..... 118/52

*Primary Examiner*—Henry J. Recla

*Assistant Examiner*—Timothy L. Maust

*Attorney, Agent, or Firm*—Ashen Golant & Lippman

[57] ABSTRACT

Apparatus and method for rapidly rotating a small enclosed transparent container and introducing a plurality of visually different materials into the rotating container to produce distinctive multi-aspect designs. The illustrated apparatus includes a support for releasibly holding one of the containers at a time for rotation about an axis, and a drive mechanism for causing the held container to rotate rapidly about that axis. The container has an entrance and the apparatus includes dispensers for selectively and sequentially introducing two or more of the visually different materials in flowable form into the entrance while the container is rotating. The materials have the capacity for maintaining themselves generally separate from the other materials in the rotating container. By way of example, the materials could be sands or gels of different colors or appearances. There may be a plurality of containers with a variety of different shapes. After a container is filled, it may be removed from the support, its entrance closed, and then used as jewelry for display, for play, etc.

28 Claims, 6 Drawing Sheets

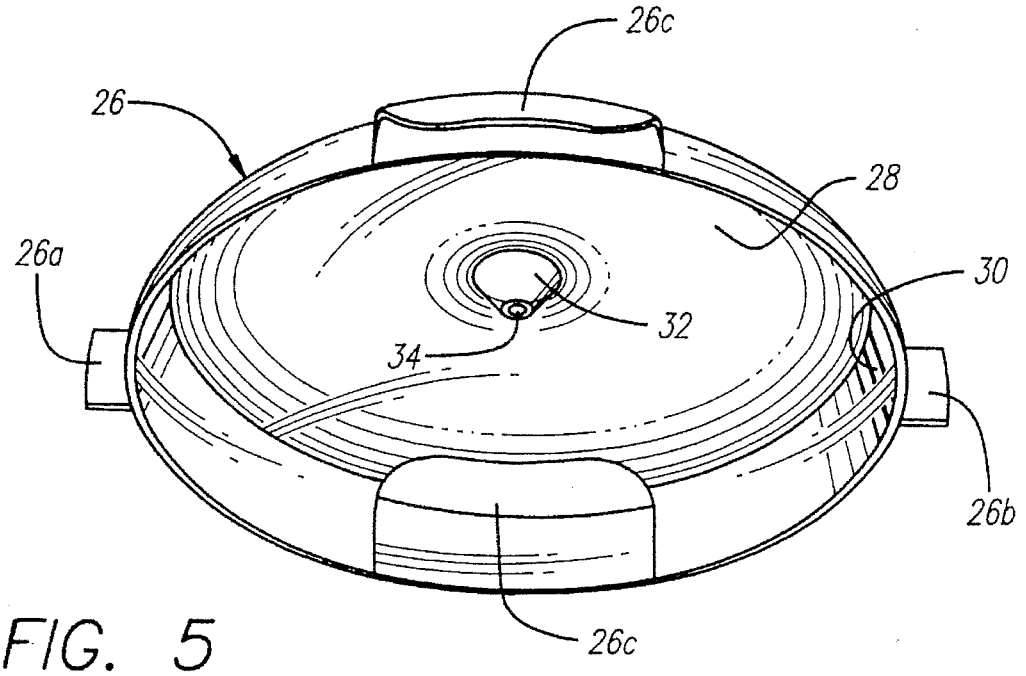
FIG. 5
FIG. 7B
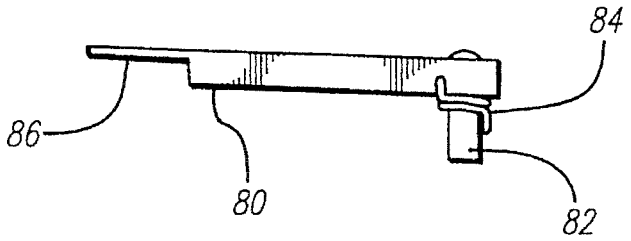
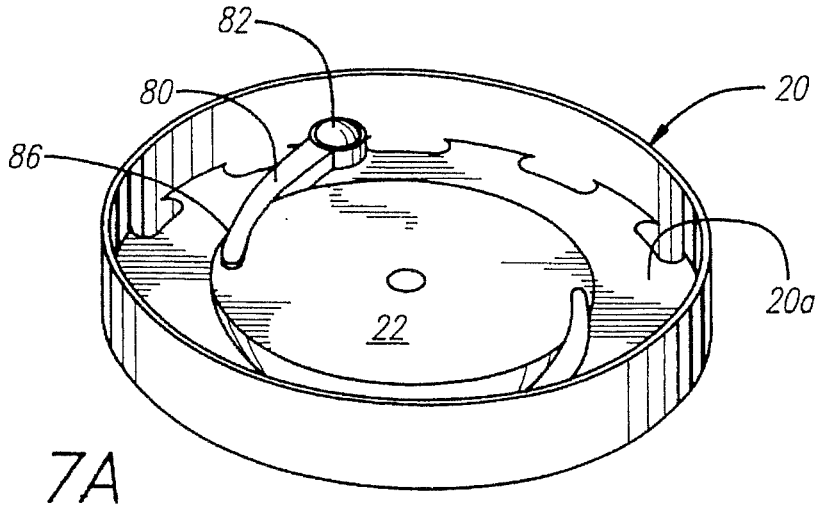
FIG. 7A

APPARATUS AND METHOD FOR RAPIDLY ROTATING CONTAINERS TO PRODUCE MULTI-ASPECT DESIGNS

FIELD OF INVENTION

Apparatus and method for producing interesting and distinctive multifaceted designs within transparent containers, with a low level of skill or expertise required from the user.

BACKGROUND OF INVENTION

The prior art includes a number of devices which are in limited ways similar to the apparatus and method of the present invention, but which differ substantially from the present invention.

For example, it is known to provide a stationary transparent bottle or container and to allow the user to selectively pour a variety of different color or otherwise visually different substances into the bottle to create a multicolor or multi-image visual effect. Since the container is stationary, the effect achieved is generally limited to a series of different layers stacked upon each other.

Another prior art device involves spinning or rotating an upwardly facing flat surface and selectively dropping different color paint onto the surface to create a splashed and irregular multicolored effect. Examples of this are shown in U.S. Pat. Nos. 3,280,792, 4,550,629 and 5,242,496. This produces a two-dimensional image on a flat surface rather than a three-dimensional multifaceted design which can be viewed from a plurality of directions and angles.

There have also been sealed transparent containers which permanently contained a plurality of liquids having different appearances and/or color and different densities so that they maintained separateness from each other in the container. The shapes of the different liquids would change as the container was rotated or otherwise moved about either manually or mechanically. This device required that there be substantial empty space within the container to facilitate the continuous reshaping and reforming of the liquids within the container. The participation or contribution of the user was limited or none at all. Each container had a permanent collection of materials that could not be changed.

SUMMARY OF THE ILLUSTRATED APPARATUS AND METHOD

The present invention contemplates rapidly rotating an enclosed transparent container while introducing a series of visually different flowable materials into the rotating container until the container is filled. The flowable materials have the characteristic of maintaining their separate integrity or separateness from the other materials so as to provide a design within the container that is multi-aspect such as multicolored.

In the illustrated apparatus, the containers are small flat enclosures disposed generally horizontally with upright generally central axes. The containers may have a plurality of different shapes. A support releasibly holds a container and a drive mechanism rotates the container about its axis. The illustrated containers each have an entrance in the top wall at about the central axis. The illustrated apparatus includes a plurality of dispensers which each contain a quantity of a visually different flowable material such as sand, gel, oil, etc. The different materials have the characteristic, as by virtue of their difference of densities or their physical discreteness, to generally maintain separate from one another as they are introduced into the rotating container. The user selectively uses the dispensers in series to sequentially provide quantities of the flowable materials into the container while it is rotating and this process continues until the container is generally filled. Centrifugal force acts to move and hold the introduced at the outer periphery of the container, and then at progressively radially more inward positions as the container becomes more and more filled. After the container is essentially fully filled, it will maintain the integrity of the multifaceted design that has been produced. The container may be removed from the support and the entrance closed as by means of a piece of tape or the like.

The containers may be used as jewelry, may be played with, displayed or otherwise utilized by the user. When desired, the tape or cover may be removed and the material within the container removed through the entrance so that the container can be reused and a new design created.

IN THE DRAWINGS

FIGS. 4*a*, 4*b*, 4*c* and 4*d* are further enlarged side sectional views showing the smaller and larger size containers in premounting and in mounted positions on the support of the apparatus.

FIG. 5 is a perspective view of the cover for the apparatus.

Figure 6B:
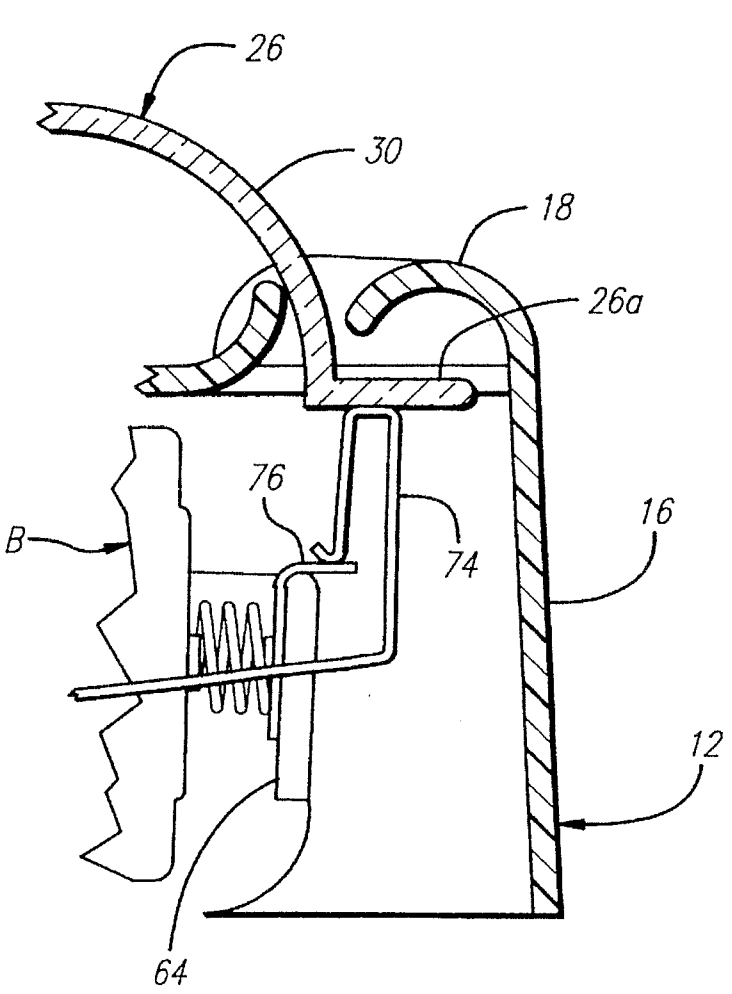
Figure 6A:
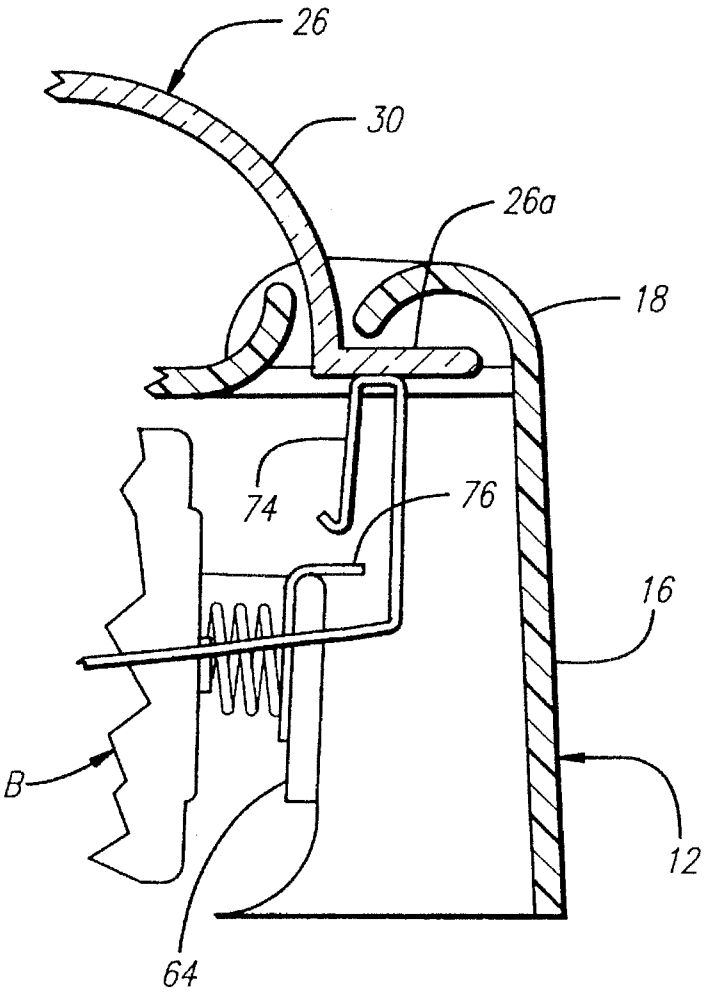

FIGS. 6*a* and 6*b* are enlarged schematic side sections of the portion of the apparatus incorporating the on/off switch, showing the off and on positions.

FIG. 7*a* is a perspective view of an alternative form of connecting and holding means for the container support of the apparatus.

FIG. 7*b* is a side view of the holding arm portion of the means of FIG. 7*a*.

DETAILED DESCRIPTION OF DISCLOSURE

A presently preferred embodiment of the apparatus of the present invention is disclosed in the drawings. The illustrated apparatus 10 includes a base 12 in the form of a housing. A support 20 is rotatably mounted on the housing 12 for holding one container 22 at a time, and rapidly rotating the container while a series of visually different flowable materials M are introduced into the rotating container to provide interesting multi-aspect visual designs.

The illustrated housing 12 has a bottom wall 14, side walls 16 and a top wall 18. The housing 12 may be constructed of any suitable material such as molded plastic or metal and may be comprised of a plurality of portions that are connected together by usual means such as adhesive.

The rotatable container support 20 is mounted generally centrally of the top wall 18. The containers 22 are releasibly held one at a time on the support 20 for common rotation about an upright axis X—X. For this purpose, the support 20 has a central connector means or structure 21.

More particularly, the housing 12 has a generally circular base portion 11 that has a flat bottom provided by bottom wall 14. The housing 12 also has a generally doughnut-shaped peripheral portion 11*a* formed by upright outer side wall 16, an arcuate portion of top wall 18, and upright inner wall 16*a*. The peripheral portion 11*a* defines a generally open center into which a thumb or peninsula portion 17 extends to about the center of the circular base portion 11. The peninsula portion 17 provides a rotatable support at its end 19 for the rotatable container support 20. The open center area forms a C-shaped trough or moat 16*b* around the peninsula portion 17.

Figure 1:
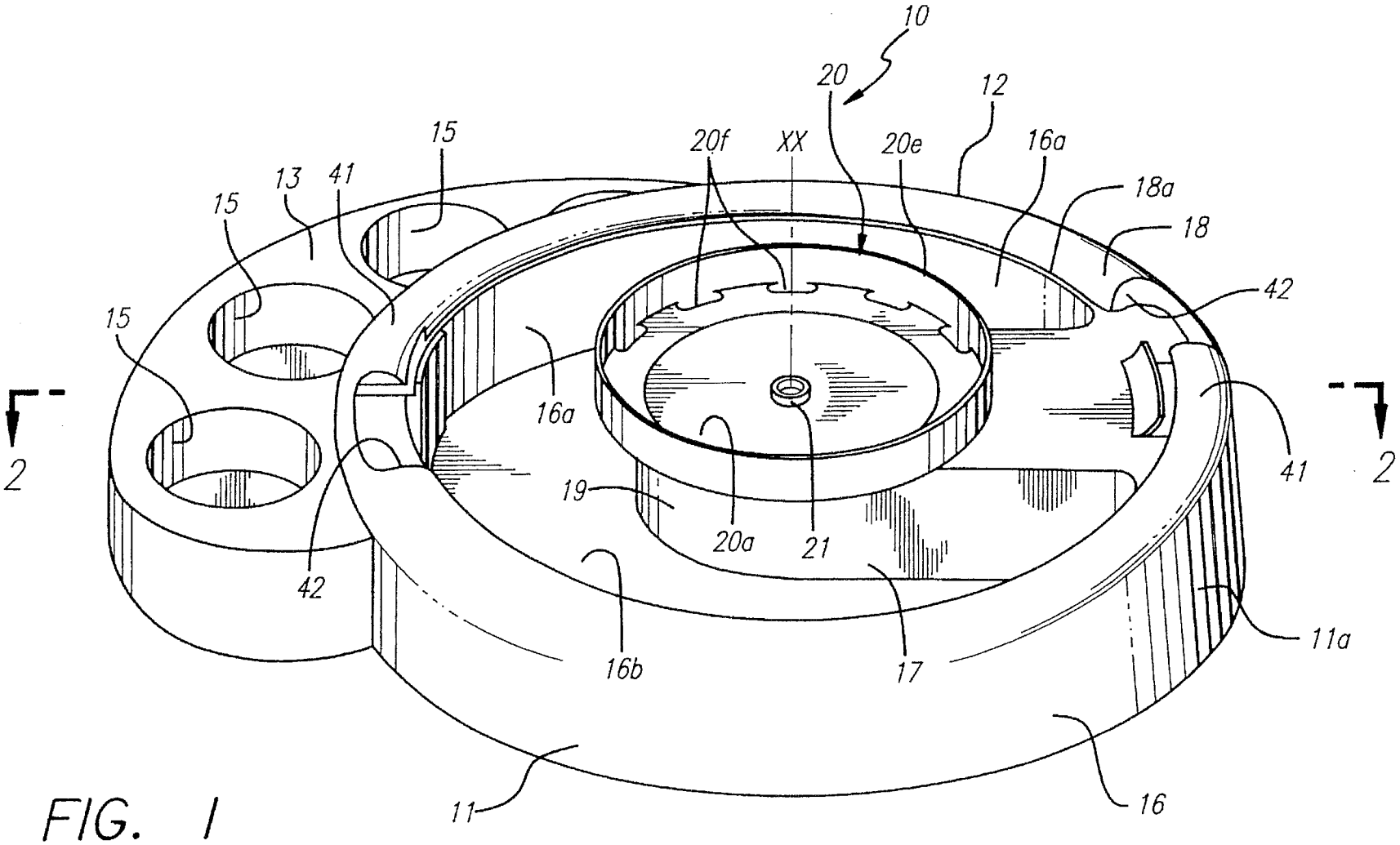
FIG. 1 is a perspective view of an apparatus which embodies a presently preferred form of the invention.
Figure 2:
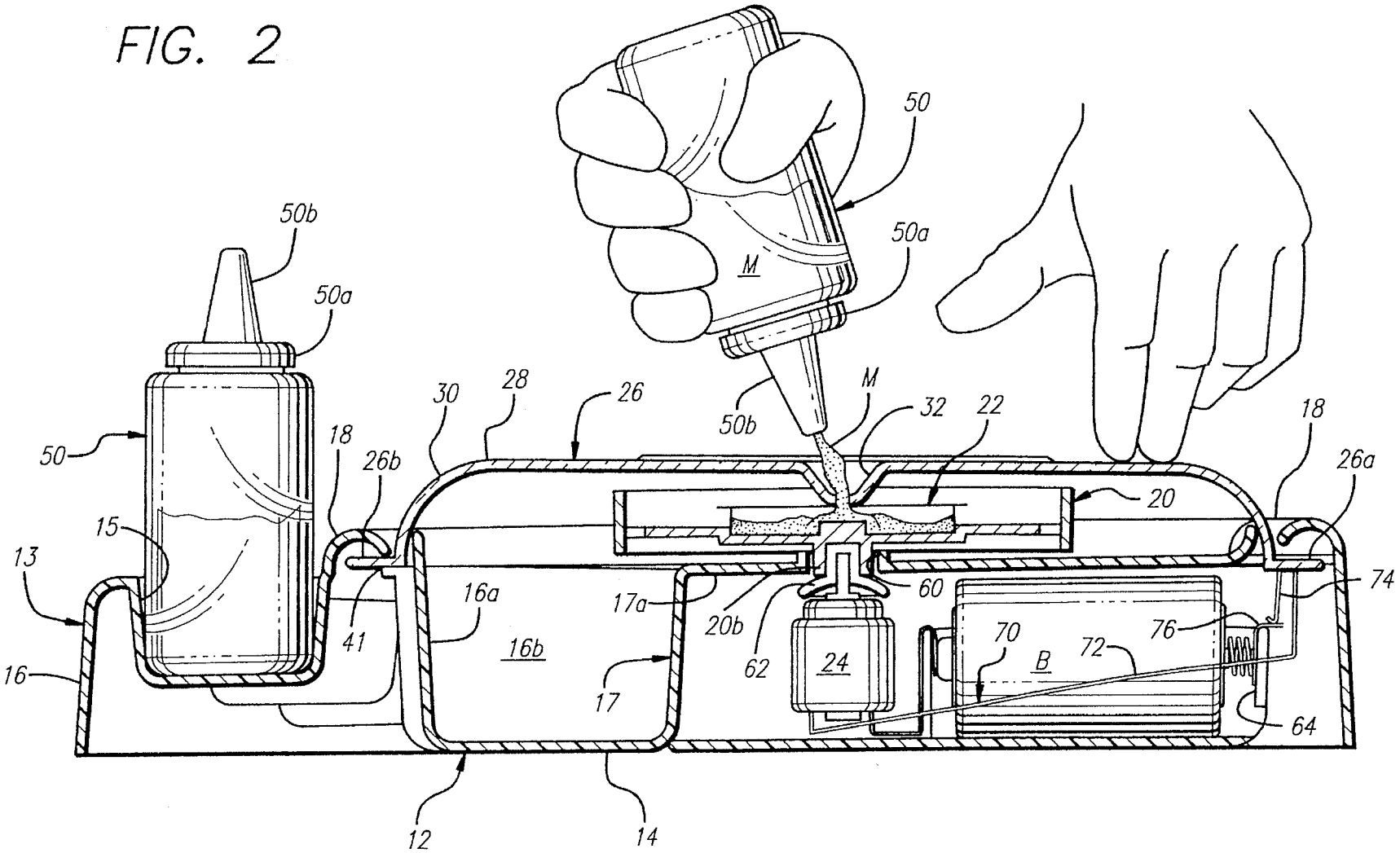
FIG. 2 is an enlarged side section view taken generally through the center of FIG. 1 generally along line 2—2.

As shown best in FIGS. 2 and 4, the illustrated support 20 is generally circular, having a horizontal bottom wall 20*a* and a central depending connector hub 20*b*. The assembled support 20 has its connector hub 20*b* extend down through a central hole 60 in the peninsula portion upper wall 17*a* at about the axis X—X of the base portion 11. The hole 60 is formed with a circular upwardly extending bearing lip that engages and supports the support bottom wall 20*a*.

Aligned with the support hub 20*b* and received within a downwardly directed receptacle 20*c* of the hub 20*b*, is an upwardly directed drive pin 62. The drive pin 62 is fixed on the upright output shaft of the motor 24. The hub receptacle 20*c* and the drive pin 62 are non-circular in cross section so that rotation of the pin 62 is transmitted to the support hub 20*b*. In this way, rotation of the motor shaft rotatably drives the support 20.

The illustrated support 20 in turn carries a mounted container 22 as the support rotates, as described in detail below.

The support 20 also has a circular outer upright wall 20*e* and a plurality of vents or openings 20*f* in the horizontal wall 20*a* adjacent the upright wall 20*e* for discharge of materials M that find their way into the support 20.

The motor 24 is supported within peninsula portion 17 of the housing and is connected to a battery B also supported in the portion 17 by standard battery support means 64. The housing 12 may have a suitable cover (not shown) to access the battery B for replacement.

The motor 24 is also connected to a spring switch member 70 that operates to close the circuit between the motor and the battery B. As shown in FIG. 2, the spring switch member 70 includes an elongated spring arm 72 that is connected at one end to a lead of the motor 24. The other lead of the motor 24 is connected to the battery B through the battery support means 64. The spring switch member 70 also has a generally U-shaped contact finger 74 at the other end of the arm 72. The finger 74 is normally biased by the arm 72 away from engagement with a contact 76 that is on the battery support means 64 and in electrical contact with the battery. The finger 74 is movable into engagement with the contact 76 to close the circuit and energize the motor 24.

The finger 74 is selectively movable into engagement with the contact 76 by the cover 26 as will be described below.

The motor 24 may alternatively be electrically connected to an electrical cord for plugging into a wall outlet.

Figure 3:
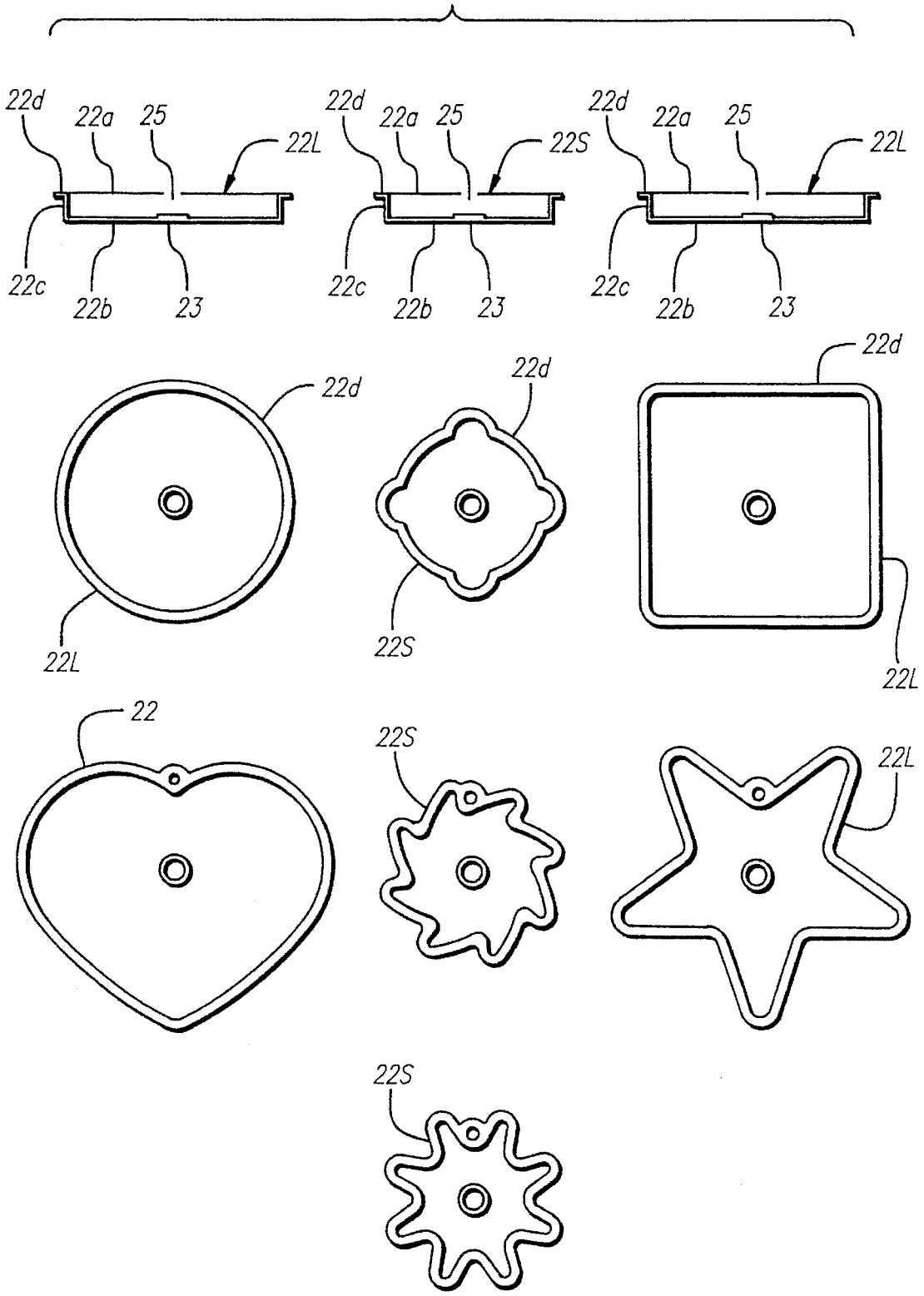
FIG. 3 illustrates a plurality of containers for use with the apparatus.
Figure 4C:
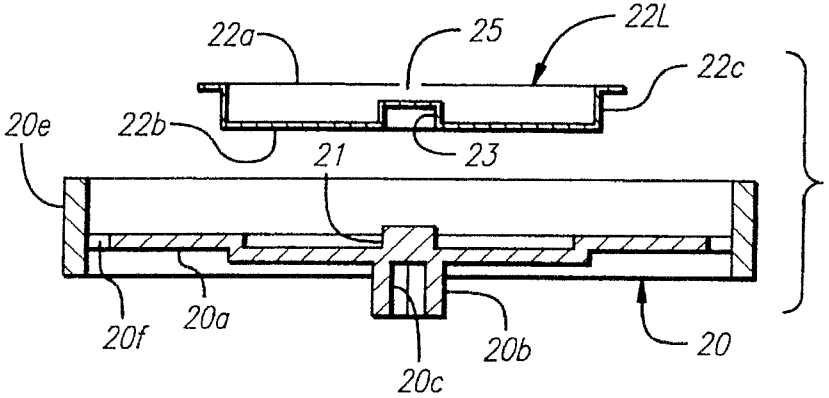
Figure 4D:
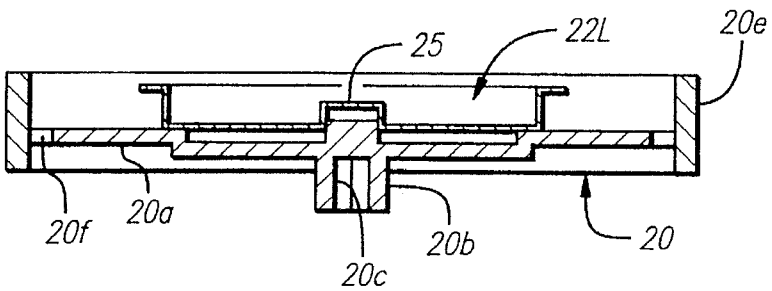
Figure 4A:
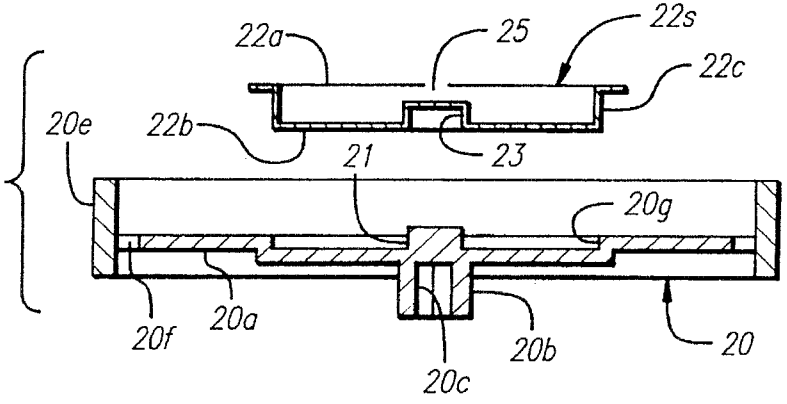
Figure 4B:
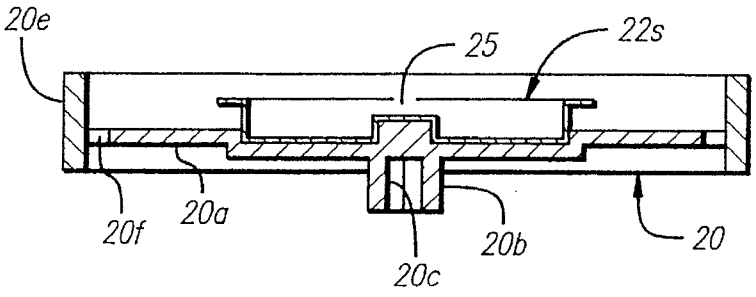

A variety of the enclosed containers 22 are shown in detail in FIG. 3. Some are smaller 22S and the others are larger 22L. All of the illustrated containers 22S, 22L are generally small and flat having generally parallel top and bottom walls 22*a*, 22*b* and a peripheral or side wall 22*c* connecting the top and bottom walls. The top and bottom walls 22*a*, 22*b* have generally the same shape as one another and may be formed in a variety of different shapes as for example a circle, a square, a heart, a star or various other shapes, some of which are illustrated in FIG. 3. Conveniently, the containers may be formed from a vacuum formed plastic sheet bottom section that includes the bottom wall 22*b* and the side wall 22*c*, and a plastic sheet top section that provides the top wall 22*a*. The sections may be secured together as by adhesive. If desired one section may be transparent and one section may be opaque, but preferably both will be transparent.

The illustrated containers 22 each have a generally central upright axis about which they are designed to rotate. Each container 22 is provided with a central connector means or structure 23 for releasibly interconnecting with the connector means 21 on the support 20 for common rotation when the container is mounted upon the support.

More particularly, each container 22 is provided in the center of its bottom wall 22*b* with a central downwardly open connecting receptacle that provides the container connecting means 23. The receptacle 23 is sized and proportioned to releasibly receive an upwardly extending central projection that provides the support connection means 21. This connection between connection means 21 and 23 maintains the rotating containers 22 centered at the axis of rotation. Further, the connection and disconnection of the illustrated containers 22 with the support 20 is by simple generally vertical up and down movement. This is desirable for younger users. Further, the horizontal wall 20*a* of the support may be formed with a circular cavity 20*g* for receiving the lower portion of the smaller size containers 22S (see FIGS. 2 and 4*b*). The larger size containers 22L simply rests upon the bottom wall 22*b* (see FIG. 4*d*). The container 22 is thus mounted so that rotation of the support 20 imparts rotation to the mounted container 22. This may be achieved by a positive interconnection or a light friction fit. The illustrated projection 21 and the receptacle 23 is circular in cross section, although other cross sections may be used.

The illustrated containers 22 may be wholly or partially transparent so that the user can see the design and disposition of material within the containers. For example, a container may have all of its walls of a clear material such as molded plastic. This is the preferred design.

Alternately, the bottom wall of the container may be opaque while the other walls are transparent or different portions of walls may be transparent while other portions are opaque to contribute a design aspect to a container. As example of this, making the containers from two sections, one transparent and one opaque is described above.

An opening or entrance 25 may be provided in the upper wall 22*a* of each container 22 generally aligned with the vertical axis of rotation.

To hold a container 22 in place on the support 20 and to facilitate funneling of flowable material into the container while it is rotating, a removable cover 26 is provided for the illustrated apparatus 10. As shown in FIG. 5, the illustrated cover 26 is generally circular with a central horizontal wall 28 and a peripheral depending side wall 30. The cover 26 also has a central depending funnel portion 32 that has a central entrance or opening 34. When the cover 26 is mounted, the entrance 34 generally aligns vertically with the entrance 25 to the supported container 22 (FIG. 2). The cover 26 is desirably transparent so the child user can continue to see what is happening as the flowable material is introduced into a rotating container.

The cover 26 is supported in its mounted closed position by an annular lip or ledge 18*a* formed around the inside of the doughnut shaped housing portion 11 adjacent top wall 18. For retaining the cover 26 on the housing 12, the cover includes a pair of opposed outwardly extending ears 26*a*, 26*b*. There are a pair of opposed cutouts 42 in the top wall 18 for initially receiving the ears 26*a*, 26*b*. The cover 26 may then be manually rotated using grip portions 26*c* (FIG. 5) to slide the ears 26*a*, 26*b* respectively under adjacent retaining portions 41 of the top wall 18 to releasibly hold the cover 26 in place.

As shown in FIG. 6*a*, when the cover 26 has been mounted on the apparatus 10, one of the ears 26*a* is positioned immediately above the switch finger 74. This allows the user to press down on the cover area adjacent to ear 26*a* and tilt the cover so that ear 26*a* engages the finger 74 and moves it into contact with the contact 76, as shown in FIGS. 2 and 6*b*. This energizes the motor 24 and rotates the container 22. The rotation continues until the user releases the downward push on the cover, which allows the finger 74 to separate from the contact 76.

FIGS. 7*a*, 7*b* illustrate an alternate means for connecting a container 22 to the rotating support 20 and for holding it in place as the support rotates. A pair of spring loaded arms 80 are each rotatably supported on an upright post 82 fixed to the bottom wall 20*a* of the support. Each arm 80 is biased radially upwardly by a small spring 84. Each arm 80 is formed at its outer end with a thin tab portion 86 that overlies a marginal portion of a mounted container to hold it in place.

The trough 16*b* that extends generally around the central support 20 receives and retains flowable material that fails to find its way into a mounted container 22. The assembled cover 26 encloses the trough 16*b* as well as the container 22.

Radially outwardly at one side of the main base portion 11, the housing 12 has a holder portion 13 that is formed with a plurality of receptacles 15 for dispensers 50 of the visually different flowable materials M. These dispensers 50 are illustrated in the form of small plastic bottles having removable caps 50*a*. Each cap 50*a* has an extended nozzle 50*b* to facilitate control of the material M being dispensed.

The child user may press down on the cover 26 to energize the motor 24 and rotate the container, and may then, as illustrated in FIG. 2, may grasp one of the dispensers 50, direct the nozzle 50*b* to the entrance 34 in the cover 26 which is aligned with the entrance 25 to the mounted container 22, and cause flowable material M from that dispenser to flow through the entrances 34, 25 into the rotating container. As noted above, the centrifugal force of the rotating container tends to move the flowable material M into the radially outward portions of the container. The user may selectively use a sequence of different dispensers 50 to create patterns of alternating materials. The different materials will accumulate in the container starting radially outwardly and moving toward the center of rotation of the container until the container is essentially filled.

Good results have been achieved by one model prototype with sand of about 0.008" in size, container entrances 25 of about 0.150 of an inch in diameter and cover entrances of about 0.220 of an inch in diameter. The containers where then rotated at about 6600 RPM when initially empty. This reduced to about 4500 RPM by the time the containers were filled.

The container may then be stopped from further rotation, the cover 26 may be removed, and the container 22 may be removed by lifting upwardly. To prevent the flowable material from leaving the container, the container entrance 25 may be closed as with a small piece of transparent tape. This allows the entrance 25 to be opened at a subsequent time to empty the container so that it may be reused.

The closed containers 22 may be utilized as jewelry, for play, for display, for collection, as the child user may desire.

The flowable material M may take various forms so long as it has certain basic characteristics desirable for the practice of the present apparatus and method. Initially, the flowable material must be capable of readily flowing from the dispensers through the entrances 34, 25 into the interior of the rotating container. Further, the various different materials must be capable of providing visually different appearances within the container. The most obvious example of this would be different colors. However, other visual differentiation may result from other visual aspects of the material. For example, granular material may be of significantly different size to produce visual differentiation. Other flowable viscous material may differ in its shininess for example.

It is further required that the different materials have the capacity to remain generally separate from each other when quantities of a series of the materials are introduced into the rotating containers. This is referred to as an ability to maintain separateness or differentiated integrity. With substance such as sand, the particles that are packed together tend to remain in that position and to form a generally solid cohesive body that will not be substantially changed or distorted by the addition of a subsequent quantity of a different color or visually different sand or particulate material. For flowable liquids, the differentiation may be achieved through a difference in density or a cohesiveness such as exhibited by oil in water.

Very good results have been achieved using different color sand as described above.

Very good results have also been achieved using transparent and/or translucent flowable viscous gels that may be tinted with different colors. The gels may also have solid particles such as glitter of one or more different colors or appearances dispensed through the gels. The gels have the capacity to flow into the containers while remaining generally separated from one another in the rotating container. This may be achieved through a cohesiveness of the gels even though they may have the same or very like densities. The transparent walls of the containers 22 filled with the transparent clear or tinted gels provide an object through which light can pass for enhanced visual attractiveness.

The presently preferred gels are made up of inorganic synthetic smectite clay colloidal dispersion in water. The dispersion in powder form is sold under the Registered Trademark "Laponite" by Laporte Industries, Ltd. of the United Kingdom. The dispersion powder is mixed with water in the dispensers 50 in concentrations by weight of about one and one-half percent (1.5%) to about four percent (4%) "Laponite."

Other colloidal dispersions or suspensions might be used to produce flowable materials with similar or equivalent rheology, i.e, viscosity properties. By way of example, Hydroxy Ethyl Cellulose might be utilized in concentrations appropriate to it.

Various changes may be made in the details of the illustrated structure without departing from the spirit and scope of the present invention as set forth in the following claims:

What is claimed is:

1. Play apparatus for producing objects with visually multi-aspect designs, said apparatus comprising:

a) an enclosed container having at least partially transparent walls, an axis for rotation, and an entrance at about the axis, b) a support for releasibly holding the container for rotation about its axis, c) a drive mechanism for causing the container held by the support to rotate rapidly about its axis, d) a plurality of dispensers for selectively introducing into the entrance of the rotating container a series of visually different flowable materials.

2. The play apparatus of claim 1 further including a holder for being removably connected to the apparatus to hold the container in place on the rotating support.

3. The play apparatus of claim 2 wherein said support includes connector means for releasibly holding the container, such holding and subsequent release of the container by the connection means being achieved by generally vertical movement, said holder including a portion that, when the holder is connected to the apparatus, overlies the container to hold it in place on the rotating support.

4. The play apparatus of claim 3 wherein said holder is a cover that is at least partially transparent.

5. The play apparatus of claim 3 wherein said holder is a cover, the apparatus also including an operating on-switch for actuating the drive mechanism to rotate the container support, the cover including a portion that is positioned, when the cover is tilted, to operate the on-switch.

6. The play apparatus of claim 1 wherein said container is symmetrical about its axis of rotation.

7. The play apparatus of claim 1 wherein said container is asymmetrical with regard to its axis of rotation.

8. The play apparatus of claim 1 wherein said containers are generally flat, each having an enlarged top wall, an enlarged bottom wall and a generally upright side wall, the axis of rotation being generally upright.

9. The play apparatus of claim 8 wherein said entrance is in said top wall.

10. The play apparatus of claim 9 wherein said entrance is generally centrally of said top wall and aligned with the axis of rotation.

11. The play apparatus of claim 1 wherein said visually different materials have different colors.

12. The apparatus of claim 1 wherein said visually different materials comprise small particulate particles.

13. The play apparatus of claim 1 wherein said visually different materials comprise gel-type flowable materials which have characteristics causing them to remain generally separated from one another incident to their introduction into the rotating container.

14. The play apparatus of claim 13 wherein said gel-type materials are generally transparent or translucent.

15. The play apparatus of claim 14 wherein at least one of said gel-type materials has a readily visible color tint.

16. The play apparatus of claim 14 wherein at least one of said gel-type materials has solid particles dispersed through such materials.

17. The play apparatus of claim 14 wherein said gel-type materials are produced from a colloidal dispersion mixed with a liquid.

18. The play apparatus of claim 17 wherein said colloidal dispersion is an inorganic synthetic smectite clay colloidal dispersion sold commercially under the Registered Trademark "Laponite".

19. The play apparatus of claim 18 wherein the "Laponite" dispersion is formulated with water in concentrations by weight from about 1.5% to about 4%.

20. The play apparatus of claim 1 wherein there are a plurality of said containers.

21. The play apparatus of claim 17 wherein the containers have different shapes.

22. An enclosed transparent container for use with an apparatus for producing objects with visually multi-aspect designs, the apparatus including a support with connector element for holding a container for common rotation, the apparatus including motor means for rapidly rotating the support and thus the container about a generally upright axis, the apparatus also including a plurality of dispensers each containing a quantity of visually different flowable material that can be selectively and sequentially introduced into the rotating container, said container comprising:

a relatively large top wall having a generally central upright axis of rotation and an entrance opening through said top wall at about said central axis, a relatively large bottom wall having generally the same size and shape as said top wall, an upright side wall connecting said top wall to said bottom wall to form the enclosed container, said bottom wall also having a connector element for releasibly interlocking with the connector element on the rotatable support for common rotation.

23. The container of claim 22 wherein said container connector element is a recessed cavity formed by the bottom wall and extending up into the interior of the container.

24. The container of claim 22 wherein said top wall is larger than the bottom wall to thereby form a peripheral lip for grasping and lifting the container off of the apparatus.

25. A method for producing objects with visually multi-aspect designs comprising the steps of:

a) providing an enclosed container having at least partially transparent wall portions, an axis for rotation, and an entrance, b) continuously and rapidly rotating the container about said axis, and c) selectively introducing a series of visually different flowable materials into the entrance while the container is rotating and until the container is generally filled.

26. The method of claim 25 further including the step of closing the entrance to the container to retain the flowable material within the container.

27. The method of claim 26 comprising the further step of reopening the entrance and emptying the flowable material from the container so that the container may be reused.

28. Play apparatus for producing objects with visually multi-aspect designs by introducing visually different flowable materials into a rotating enclosed container, said apparatus comprising:

a) at least one enclosed container, said container being at least partially transparent, said container having an axis of rotation and an entrance at the axis, b) a frame, c) a support rotatably mounted on the frame for rotation about the axis of rotation of the support and for releasibly holding said container with the axis of the container aligned with the axis of the support, and d) a drive mechanism on the frame for rapidly rotating the support about its axis of rotation, whereby the container is rapidly rotated and a plurality of visually different flowable materials can be introduced into the entrance of the rotating container.

* * * * *